US005170576A

United States Patent [19]

Steinkühler et al.

[11] Patent Number: 5,170,576

[45] Date of Patent: Dec. 15, 1992

[54] CUTTING WHEEL ARRANGEMENT FOR SUCTION DREDGE

[75] Inventors: Siegfried Steinkühler, Bad Schwartau; Heiko Stehmeier, Stockelsdorf, both of Fed. Rep. of Germany

[73] Assignees: O & K Orenstein; Koppel Aktiengesellschaft Berlin, Berlin, Fed. Rep. of Germany

[21] Appl. No.: 794,810

[22] Filed: Nov. 15, 1991

Related U.S. Application Data

[63] Continuation of Ser. No. 696,319, Apr. 30, 1991, abandoned, which is a continuation of Ser. No. 560,013, Jul. 26, 1990, abandoned, which is a continuation of Ser. No. 418,955, Oct. 10, 1989, abandoned, which is a continuation of Ser. No. 226,546, Jul. 29, 1988, abandoned, which is a continuation of Ser. No. 21,697, Mar. 4, 1987, abandoned.

[30] Foreign Application Priority Data

Mar. 10, 1986 [DE] Fed. Rep. of Germany ..... 3607838

[51] Int. Cl.[5] ..... E02F 3/92

[52] U.S. Cl. ..... 37/66

[58] Field of Search ..... 37/64, 66, 67, 58, 180, 37/190, 191

[56] References Cited

U.S. PATENT DOCUMENTS

| | | | |
|---|---|---|---|
| 1,393,680 | 10/1921 | Fruhling et al. | 37/66 |
| 3,084,747 | 4/1963 | Ferris | 172/122 X |
| 3,171,220 | 3/1965 | Schram | 37/66 |
| 4,102,064 | 7/1978 | Pot | 37/66 X |
| 4,646,449 | 3/1987 | Steinkuhler et al. | 37/66 |

FOREIGN PATENT DOCUMENTS

| | | | |
|---|---|---|---|
| 473767 | 3/1929 | Fed. Rep. of Germany . | |
| 1634808 | 8/1970 | Fed. Rep. of Germany . | |
| 3213179 | 10/1982 | Fed. Rep. of Germany | 37/66 |
| 3426328 | 1/1986 | Fed. Rep. of Germany | 37/66 |

*Primary Examiner*—Clifford D. Crowder
*Attorney, Agent, or Firm*—Anderson Kill Olick & Oshinsky

[57] ABSTRACT

A cutting wheel arrangement for a suction dredge includes a cutting wheel assembly provided with a plurality of cutting stirrups. A suction pipe is connected to a suction chamber arranged within the cutting wheel arrangement. The suction chamber has a suction opening in the suction area. The cutting wheel assembly includes two coaxially adjacent cutting wheels which are fixedly connected to each other and have lateral cutting openings. The suction chamber is separated by a center wall into two separate chamber portions. One of the suction chamber portions is located in the region of one cutting wheel and the other suction chamber portion is located in the region of the other cutting wheel. Each suction chamber portion is connected to the suction pipe through an opening which can be closed by means of an adjustable flap member in such a way that either the one or the other suction chamber portion is in communication with the suction pipe. The suction chamber is located predominantly in the lower region of the cutting wheels. The cutting wheel arrangement is operated in such a way that the direction of rotation of the cutting wheels moves the cutting stirrups toward and past the suction opening the region of the suction chamber portions.

3 Claims, 1 Drawing Sheet

CUTTING WHEEL ARRANGEMENT FOR SUCTION DREDGE

This is a continuation of application Ser. No. 07/696,319, filed Apr. 30, 1991, abandoned which is a continuation of Ser. No. 07/560,013, filed Jul. 26, 1990, abandoned which itself is a continuation of Ser. No. 07/418,955, filed Oct. 10, 1989, abandoned which in turn in a continuation of Ser. No. 07/226,546, filed Jul. 29, 1988, abandoned, which in turn is a continuation of Ser. No. 07/021,697, filed Mar. 4, 1987, abandoned.

BACKGROUND OF THE INVENTION

1. Field of the Invention

The present invention relates to a method of operating a cutting wheel arrangement for a suction dredge and an arrangement for carrying out the method.

2. Description of the Prior Art

German Patent 3,015,452 shows and describes a bucket wheel for a suction dredge. The bucket wheel is mounted so as to be rotatable about a horizontal axis and has excavating buckets provided uniformly spaced apart on the outer circumference of its bucket wheel body. Each bucket wheel is U-shaped as seen in radial cross-section of the bucket wheel. The free bucket ends are connected to the bucket wheel body and each have an inlet opening facing forwardly in the direction of rotation of the bucket wheel. This inlet opening is greater than its outlet opening. The bucket wheel defines an opening on the outer circumference extending over the entire length thereof between the sides of the U-shape of the excavating buckets. Adjacent this opening is located the suction mouth of a suction line extending through a stationary side wall of the bucket wheel into the interior of the bucket wheel. The suction mouth has on its upper edge an extension which extends at an angle directed against the direction of rotation of the bucket wheel through this opening and into the outlet openings of the excavating buckets.

The outer end of this extension is located on the same level as the axis of rotation of the bucket wheel. In the radial cross-section, the excavating buckets may have an essentially rectangular or trapezoidal shape, while in the tangential cross-section they may also have a trapezoidal shape.

German Offenlegungsschrift 2,907,485 describes and shows a bucket wheel having a flat, cylindrical body with at least one, partially open side surface. The cylindrical peripheral plane thereof has openings which lead into the buckets which are connected to the bucket wheel and are provided with cutting teeth. The shaft of the bucket wheel is supported by bearings which are located at a forked outer end of the bucket flight of the excavator boom. The shaft may be driven through a gear wheel by means of a hydraulic motor.

The main portion of the cylindrical body includes a box-like suction device which has an open side in the form of a circular arc defining a suction opening and extends near the inner surface of the cylindrical peripheral plane of the main portion of the bucket wheel body. The box-like suction device is mounted by means of a flange connection to a fastening device which is held by the shaft of the bucket wheel. An adjusting device including a piston and a cylinder is rotatably connected on one of its ends to the bucket flight and at its other end to the fastening device, so that the box-like suction device can be swung by means of the adjusting device.

On a side of the suction device is provided an opening which is connected to a pipe bend. The other end of the pipe bend is connected to a flexible pipe which, in turn, is connected to a suction pipe by means of another pipe bend.

U.S. Pat. No. 4,058,914 discloses a suction dredge of a suction head of special construction connected to a suction pipe. The suction head is composed of a tee whose central portion is connected to the suction pipe, while the two side pieces have fastening flanges. A cutting device is provided on each fastening flange. The cutting device includes a tubular portion in which is mounted a drive motor. Each drive motor is connected to a cutting wheel which has outwardly projecting knives arranged in a circle, wherein the planes of the knives are inclined conically. The cutting device additionally includes a helically-shaped component from which the cutting knives project outwardly.

In the T-shaped manifold to which the two outwardly projecting cutting devices are fastened are pivotally mounted a pipe flap, the pivot axis of the flap extending perpendicularly to the connecting piece of the T-shaped manifold.

The flap opens at its forward end in a slide member which, in its first position, closes the connecting opening of one suction pipe and, in the second position, closes the suction opening of the other suction pipe. The flap may be adjusted by means of an adjusting device on board the ship.

German Auslegeschrift 2,305,859 shows and describes a cutting suction head with a pair of cutting disks mounted on the ends of a driven shaft. Each cutting disk has a plurality of essentially strip-shaped cutting blades. The cutting blades are arranged on the circumference of the cutting disk and extend in radial and axial direction. A suction pipe with its suction opening extends between the cutting disks. The suction pipe is arranged above the driven shaft. A guide plate is provided between the cutting blades of the pair of cutting disks. The guide plate extends from its fastening point at the suction opening along the circumference of the cutting disks to the vicinity of the bottom side of the cutting head. The cutting disks rotate in direction of the suction opening.

The above-described arrangement has the disadvantage that the material to be removed by suction is conveyed against the force of gravity into the suction pipe opening provided above the drive shaft. This disadvantage results in a reduced volumetric efficiency of the suction pipe.

It is the primary object of the present invention to provide a cutting wheel arrangement for a suction dredge of the aforementioned type which ensures that the material cut by the cutting stirrups or blades is removed with a high volumetric efficiency.

SUMMARY OF THE INVENTION

In accordance with the present invention, a cutting wheel arrangement for a suction dredge includes a cutting wheel assembly provided with a plurality of cutting stirrups. A suction pipe is connected to a suction chamber arranged within the cutting wheel arrangement. The suction chamber has a suction opening in the suction area. The cutting wheel assembly includes two coaxially adjacent cutting wheels which are fixedly connected to each other and have lateral cutting openings. The suction chamber is separated by a center wall into two separate chamber portions. One of the suction chamber portions is located in the region of one cutting wheel and the other suction chamber portion is located in the region of the other cutting wheel. Each suction chamber portion is connected through an opening which can be closed by means of an adjustable flap member in such a way that either the one or the other suction chamber portion is in communication with the suction pipe. The suction chamber is located predominantly in the lower region of the cutting wheels. The cutting wheel arrangement is operated in such a way that the direction of rotation of the cutting wheels moves the cutting stirrups toward and past the suction opening in the region of the suction chamber portions.

The solution in accordance with the present invention ensures that the characteristic advantages of bucket wheel excavation, such as, uniform and clear cutting conditions, are maintained, and that a continuous removal of the material with high efficiency is obtained. The material loosened by the cutting stirrups is directly taken in through the suction wheel openings.

The invention provides particularly an improvement of the hydraulic conditions in the suction opening area because the direction of rotation of the cutting wheels causes the cut material to be supplied directly toward the suction openings. A very high volumetric efficiency can be achieved due to the fact that the direction of rotation of the cutting wheels in the suction opening area coincides with the suction direction of the cut material.

Since at all times the suction chamber portion corresponding to the cutting wheel which does not convey material can be closed off, it can be prevented that additional water is taken in and also conveyed.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there is illustrated and described a preferred embodiment of the invention.

DETAILED DESCRIPTION OF THE INVENTION

Figure 1:
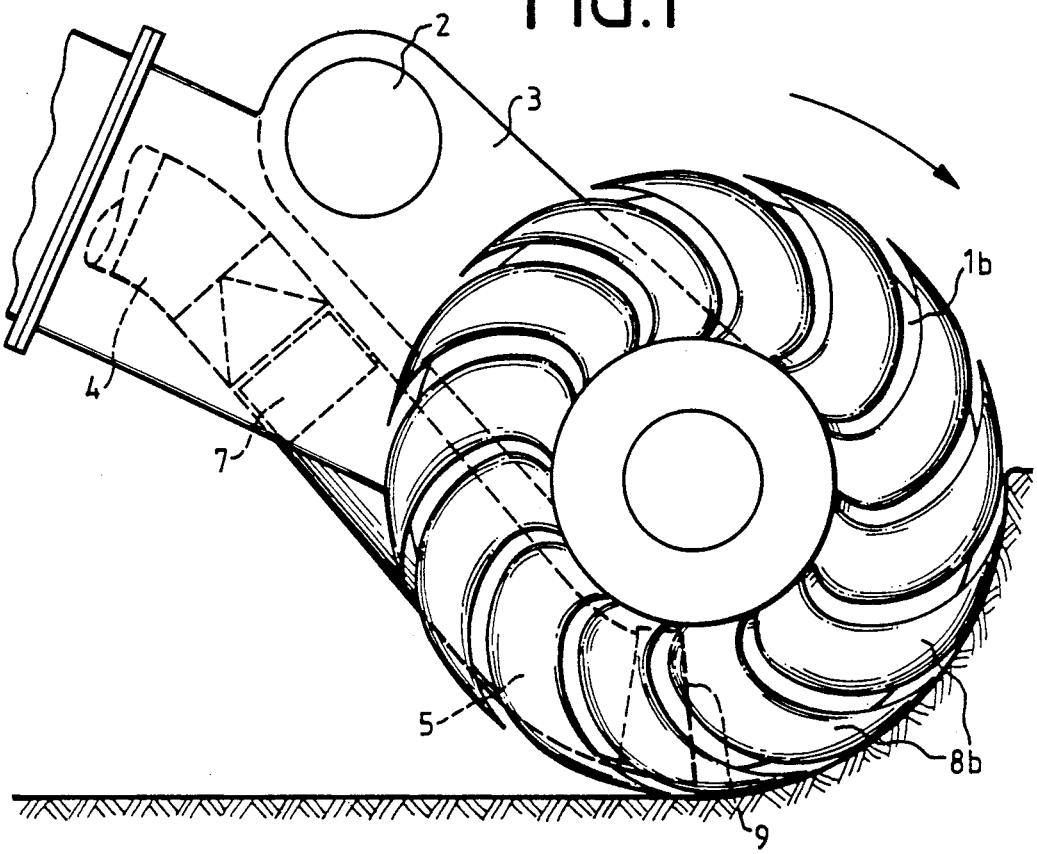
FIG. 1 is a side elevational view of the cutting sheet arrangement according to the invention.

As illustrated in FIG. 1, the cutting sheet arrangement for a suction dredge has two cutting wheels 1*a* and 1*b* which are both hydraulically driven through a hydraulic motor 2 and gear unit 3 integrated into the support structure of a suction pipe boom.

The suction pipe 4 ends in two suction chamber portions 5*a* and 5*b* which are provided within the centrally arranged wheel carrier and are separated from each other by a central wall 6. An adjustable flap 7 is provided, so that, in dependence upon the direction in which the suction pipe boom is swivelled during the dredging operation, the suction pipe 4 is in communication only with that one of the suction chamber portions 5*a* or 5*b* which corresponds to the cutting wheel 1*a* or 1*b* performing a conveying operation at a given time.

Cutting stirrups 8*a* and 8*b* are provided on the cutting wheels and define lateral cutting wheel openings for receiving the removed material into the suction chamber portions.

FIG. 1 further shows that the suction chamber portions 5*a* and 5*b* are predominantly located in the lower region of the cutting wheels 1*a* and 1*b*, i.e., directly in front of the material to be cut.

Moreover, FIG. 1 shows that the cutting stirrups 8*a* and 8*b* are sickle-shaped. They are arranged so as to be convex in direction of rotation. The direction of rotation of the cutting wheels 1*a* and 1*b* is indicated by an arrow in FIG. 1. Accordingly, as seen in FIG. 1, the cutting stirrups 8*a* and 8*b* move from the material to be cut in front of the cutting wheel arrangement toward the suction opening and then past the suction chamber portions.

Figure 2:
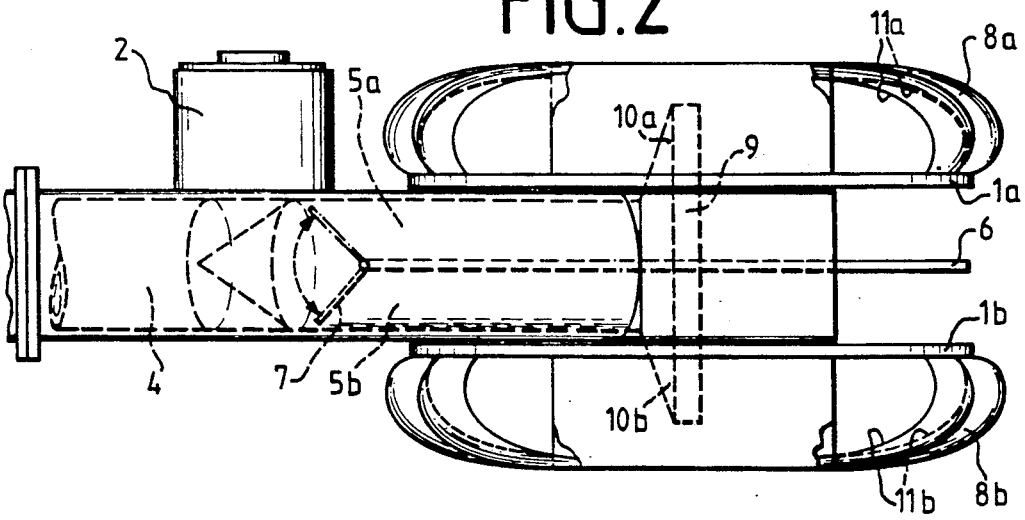
FIG. 2 is a top view of the cutting wheel arrangement of FIG. 1.

In FIG. 2, identical structural components are denoted by the same reference numerals as those used in FIG. 1.

FIG. 2 additionally shows that the suction chamber portions 5*a* and 5*b* have widening sections 10*a* and 10*b* which extend into the interior of the cutting wheels 1*a* and 1*b*. The widening sections may advantageously be constructed so as to extend up to the inner edges 11*a* and 11*b* of the cutting stirrups.

The above-described cutting wheel arrangement makes it possible to carry out dredging operations which are needed for maintaining and expanding underwater structures. Since it is easily possible to laterally swivel the suction pipe boom, so that a large working area can be covered toward each side and a large amount of material can be removed, the accompanying dredge can be easily guided and especially well positioned. Furthermore, the same arrangement makes it possible to produce raw materials underwater; this is possible even when the material must be loosened mechanically requiring the application of substantial forces.

While the specific embodiment of the invention has been shown and described in detail to illustrate the application of the inventive principles, it will be understood that the invention may be embodied otherwise without departing from such principles.

We claim:

1. A cutting sheet arrangement for a suction dredge, comprising:

a cutting wheel assembly including first and second cutting wheels located adjacent and fixedly connected to each other and having a front, the cutting wheels defining lateral cutting openings;

a plurality of cutting stirrups attached to the cutting wheels;

a suction chamber arranged between the cutting wheels so as to have a forwardly directed suction opening directly below the axis of rotation of the cutting wheels and adjacent to an outer perimeter of the wheels, the suction chamber having expanded sections provided in an intake area of the suction opening so as to extend into the region of the inner edges of the cutting stirrups;

a suction pipe connected to the suction chamber;

a center wall member separating the suction chamber into first and second chamber portions, wherein the first suction chamber portion is located in the region of the first cutting wheel and the second suction chamber portion is located in the region of the second cutting wheel, the suction chamber portions having openings to effect communication with the suction pipe;

an adjustable flap capable of closing either the opening of the first suction chamber portion or the opening of the second suction chamber portion, so that either the first or the second suction chamber portion is in communication with the suction pipe, the direction of rotation of the cutting wheels being such that the cutting stirrups move downwardly and rearwardly toward the expanded sections of the suction chamber rom the front of the cutting wheel assembly and then past the suction opening in the region of the suction chamber portions so as to direct cut material directly into the respective expanded sections of the suction chamber.

2. The cutting wheel arrangement according to claim 1, wherein the cutting stirrups have the shape of sickles.

3. The cutting wheel arrangement according to claim 2, wherein the cutting stirrups are arranged so as to be convex in direction of rotation.

* * * * *